US009500097B2

(12) United States Patent
Barlog et al.

(10) Patent No.: US 9,500,097 B2
(45) Date of Patent: Nov. 22, 2016

(54) TURBOCHARGER CONTAINMENT ASSEMBLY

(75) Inventors: Daniel J. Barlog, DeMotte, IN (US); Harry Hruska, Hebron, IN (US)

(73) Assignee: Precision Turbo & Engine Rebuilders, Inc., Hebron, IN (US)

( * ) Notice: Subject to any disclaimer, the term of this patent is extended or adjusted under 35 U.S.C. 154(b) by 935 days.

(21) Appl. No.: 13/452,895

(22) Filed: Apr. 22, 2012

(65) Prior Publication Data

US 2013/0280056 A1 Oct. 24, 2013

(51) Int. Cl.
*F01D 21/00* (2006.01)
*F01D 21/04* (2006.01)

(52) U.S. Cl.
CPC ..... *F01D 21/045* (2013.01); *F05D 2220/40* (2013.01)

(58) Field of Classification Search
CPC .. F01D 21/045; F01D 25/00; F05D 2220/40; F02B 39/16; F02B 37/02; B01D 46/08; B01D 46/522; B01D 2275/203; B01D 2279/60; F02M 35/10137; F02M 35/021; F02M 35/024
USPC ..... 415/121.2, 9; 417/406
See application file for complete search history.

(56) References Cited

U.S. PATENT DOCUMENTS 3,692,436 A * 9/1972 Connor et al. ..... 417/406
4,077,739 A * 3/1978 Heilenbach ..... 415/121.2
4,303,377 A * 12/1981 Schwartzman ..... 417/406
4,821,520 A * 4/1989 Rumfield ..... 60/614
5,556,255 A * 9/1996 Kieffer ..... 415/212.1
7,174,709 B1 * 2/2007 Trager ..... 60/311
7,794,213 B2 * 9/2010 Gaude et al. ..... 417/312
2004/0071550 A1 * 4/2004 Martin et al. ..... 415/205
2006/0191604 A1 * 8/2006 Itoh et al. ..... 148/321
2011/0041494 A1 * 2/2011 Parker et al. ..... 60/605.1

OTHER PUBLICATIONS

Garrett, "White Paper No. 2 Burst & Containment: Ensuring Turbocharger Safety" Jan. 13, 2012. _Internet Archive_. [http://web.archive.org/web/20120113043000/http://www.turbobygarrett.com/turbobygarrett/sites/default/files/Garrett_White_Paper_02_Burst_Containment.pdf].*

* cited by examiner

*Primary Examiner* — Igor Kershteyn
*Assistant Examiner* — Eldon Brockman
(74) *Attorney, Agent, or Firm* — Ice Miller LLP

(57) ABSTRACT

A turbine assembly and turbocharger containing the same are disclosed. Such an assembly can include a turbine housing for a turbocharger having an inlet portion, a central portion, and a hollow cylindrical portion defining a hollow passageway and an outlet. The inlet portion, central portion, and hollow cylindrical portion are in fluid connection with one another which allows a fluid to enter and pass through the inlet portion to the central portion, pass through the central portion to the hollow passageway, and pass through the hollow passageway to exit the turbine housing through the outlet. The assembly also includes a containment assembly at least partially disposed in the hollow passageway of the hollow cylindrical portion.

10 Claims, 6 Drawing Sheets

TURBOCHARGER CONTAINMENT ASSEMBLY

BACKGROUND

Turbochargers are typically used with an engine to improve the engine's volumetric efficiency. Turbochargers include a turbine wheel within a turbine housing. The turbine wheel is a rotating component that is used to extract energy from exhaust gases that pass through the turbine housing. Unfortunately, turbocharger turbines can catastrophically fail resulting in fragmentation of the turbine blades and hub. This type of failure is referred to as a burst and can have many root causes such as material contaminants, improper heat treat, inadequate attachment to the shaft, excessive temperature, and excessive rotational speed. Given the high rotation speeds of the turbine wheel, a burst failure can cause fragments of the turbine wheel to become dangerous projectiles.

Up until now, turbine housings were only designed to contain fragments of the turbine wheel that traveled in a radial direction from the turbine wheel. However, the fragments of the turbine wheel created by a burst failure do not always travel in a radial direction. In fact, the fragments could exit the turbine housing outlet and cause a great deal of damage to systems nearby, such as engine parts. There have been attempts to create an exhaust pipe, which attaches to the turbine housing to carry away exhaust gases, with cross bars for slowing down fragments of the turbine wheel that travel through the exhaust pipe. However, such exhaust pipe designs still permit fragments of the turbine wheel to break through the walls of the exhaust pipe, including those portions of the exhaust pipe between the cross bars and the turbine housing.

Accordingly, there exists a need for a turbine assembly that can contain flying fragments of turbine wheel in order to prevent them from escaping and harming other systems nearby.

SUMMARY

The present disclosure discloses a turbine assembly and a turbocharger including the turbine assembly. Such a turbine assembly includes a turbine housing for a turbocharger having an inlet portion, a central portion, and a hollow cylindrical portion defining a hollow passageway and an outlet. The inlet portion, central portion, and hollow cylindrical portion are in fluid connection allowing a fluid to enter and pass through the inlet portion to the central portion, pass through the central portion to the hollow passageway, and pass through the hollow passageway to exit the turbine housing through the outlet. The turbine assembly also includes a containment assembly at least partially disposed in the hollow passageway of the hollow cylindrical portion.

In at least one embodiment of a turbine assembly of the present disclosure, the turbine assembly includes a turbine housing and a containment assembly. The turbine housing includes a hollow central portion having a central opening and a turbine wheel adjacent to the central opening and a hollow cylindrical inlet portion having a first inlet end and a second inlet end. The first inlet end defines an inlet opening and the second inlet end is connected to the central portion. The turbine housing also includes a hollow cylindrical outlet portion having a first outlet end and a second outlet end. The first outlet end is connected to the hollow central portion about the central opening and the second outlet end defines an outlet opening. The hollow cylindrical inlet portion, hollow central portion, and hollow cylindrical outlet portion are fluidly connected such that a fluid can enter the first inlet end, pass through the hollow cylindrical inlet portion to the second inlet end, enter and pass through the hollow central portion, and exit through the outlet. The containment assembly is at least partially disposed in the hollow cylindrical outlet portion and configured to obstruct the movement of portions of the turbine wheel through the hollow cylindrical outlet portion.

In at least one embodiment of a turbocharger of the present disclosure, the turbocharger includes the turbine assembly and a turbine wheel that is disposed within the central portion of the turbine assembly adjacent to the hollow cylindrical portion of the turbine assembly. The containment assembly of the turbine assembly is configured to obstruct the movement of portions of the turbine wheel through the hollow passageway leading to the outlet of the turbine housing.

BRIEF DESCRIPTION OF THE DRAWINGS

The features and advantages of this disclosure, and the manner of attaining them, will be more apparent and better understood by reference to the accompanying drawings, wherein.

DETAILED DESCRIPTION

Figure 1:
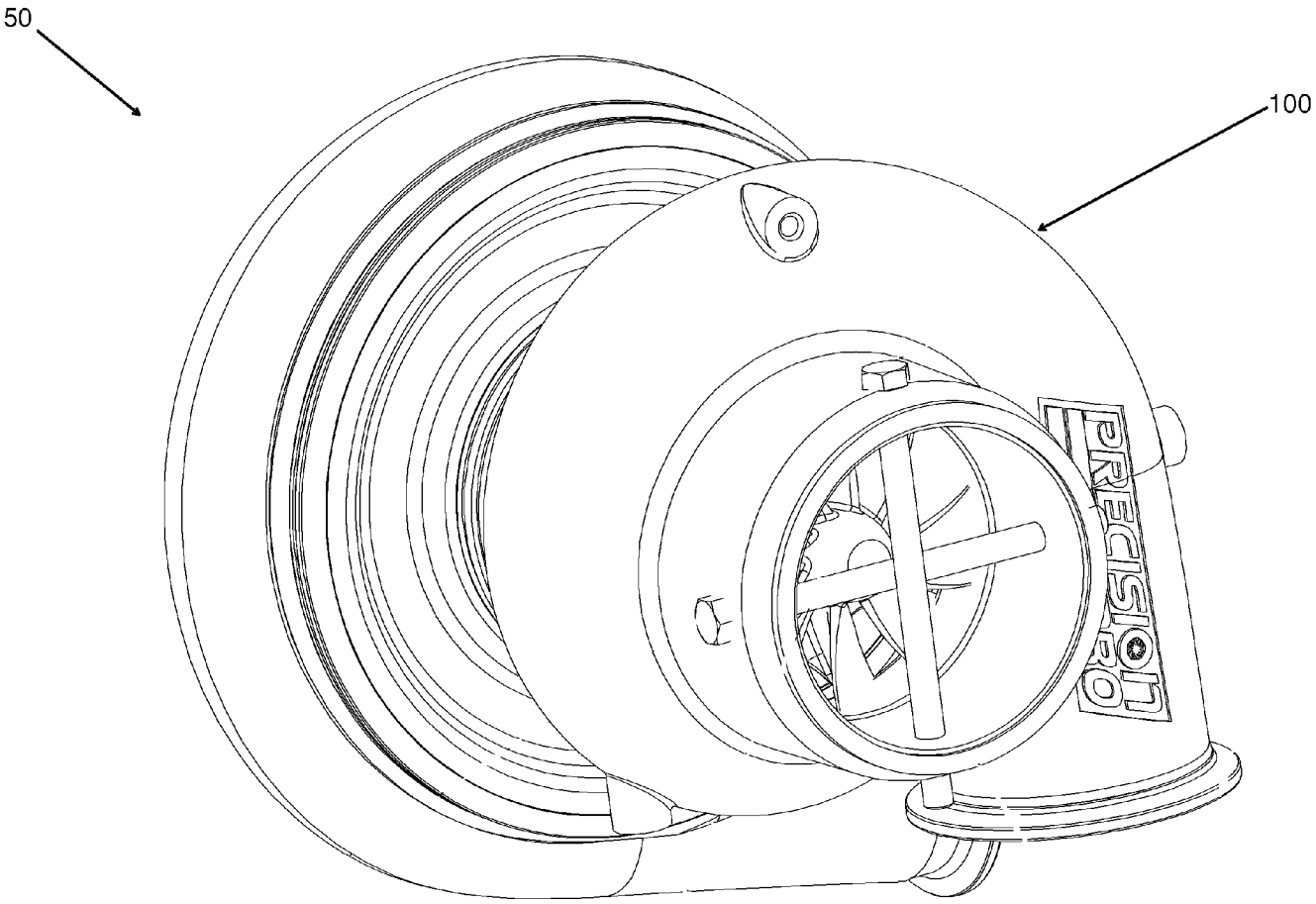
FIG. 1 shows a perspective view of an exemplary turbocharger having a two-bolt containment assembly according to the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 2A:
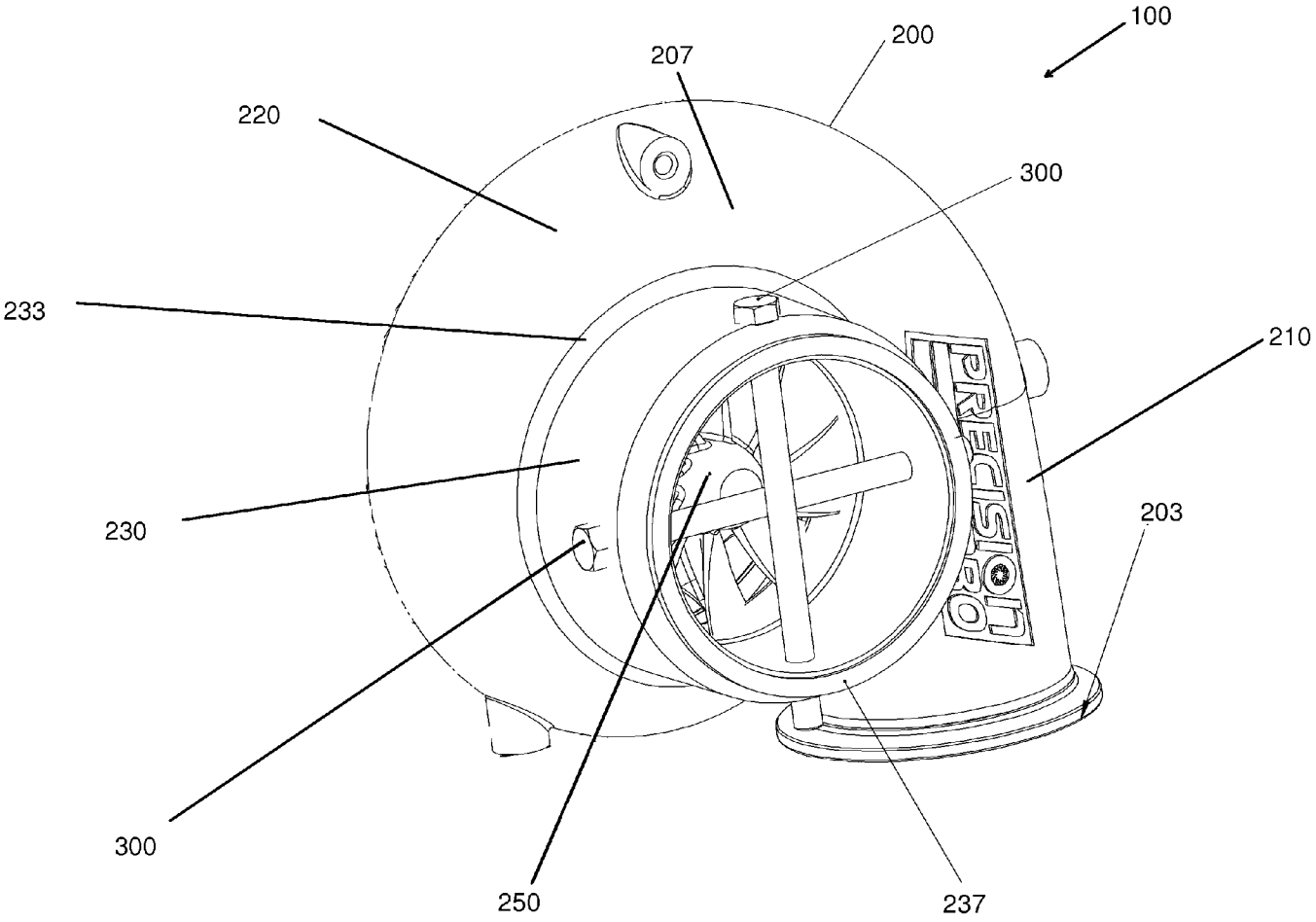
FIG. 2*a* shows a perspective view of the turbine assembly in FIG. 1.

FIG. 1 shows a perspective view of an exemplary embodiment of a turbocharger 50 having a turbine assembly 100 according to the present disclosure. FIG. 2*a* shows a perspective view of the turbine assembly 100 according to the present disclosure. As shown in FIG. 2*a*, the turbine assembly 100 includes a turbine housing 200, a turbine wheel 250 disposed within the turbine housing 200, and a containment assembly 300. As discussed further below, the containment assembly 300 is configured to obstruct the passageway between the turbine wheel 250 and the outlet 237 of the turbine housing 200 such that when the turbine wheel 250 experiences a burst failure or otherwise fails, the containment assembly 300 is able to slow down or block the movement of fragments of the turbine wheel 250 traveling through the outlet portion 230 towards the outlet 237 of the turbine housing 200. By resisting or blocking the movement of fragments of the turbine wheel 250 in such a manner, the turbine assembly 100 effectively contains the failure of the turbine wheel 250 thereby protecting systems located nearby to the assembly 100.

As shown in FIG. 2*a*, the turbine housing 200 includes an inlet portion 210, a central portion 220, and an outlet portion 230. In FIG. 2*a*, the inlet portion 210 is a hollow cylinder that includes an inlet 203 and an intermediate inlet portion 207 (shown in FIG. 2*b*). The inlet 203 is configured to receive exhaust gases from an engine (e.g., internal combustion engine). For example, a hose or other connecting member may connect the exhaust port of an engine to the inlet 203. After exhaust gas is received by the turbine housing 200 at the inlet 203, the gas travels through the inlet portion 210 between the inlet 203 to the intermediate inlet portion 207. The inlet portion 210 may be various diameters and thicknesses depending upon the application. The gas continues traveling through the turbine housing 200 by entering the central portion 220, which is fluidly connected to the intermediate inlet portion 207. The central portion 220 is a hollow pathway that fluidly connects the inlet portion 210 and the outlet portion 230. While circulating within the central portion 220, the exhaust gas interacts with and passes by the turbine wheel 250, which is disposed within the central portion 220, such that the turbine wheel 250 begins to rotate. The central portion 220 and turbine wheel 250 may be various sizes and thicknesses depending upon the application. After the exhaust gas passes by the turbine wheel 250, the exhaust gas exits the central portion 220, and enters the outlet portion 230 through the outlet opening 233. The exhaust gas passes through the outlet portion 230, around the containment assembly 300, and exits the turbine housing 200 through the outlet 237 of the outlet portion 230. Typically, after exiting the turbine housing 200, the exhaust gas enters a hose that empties to the ambient air.

Figure 2B:
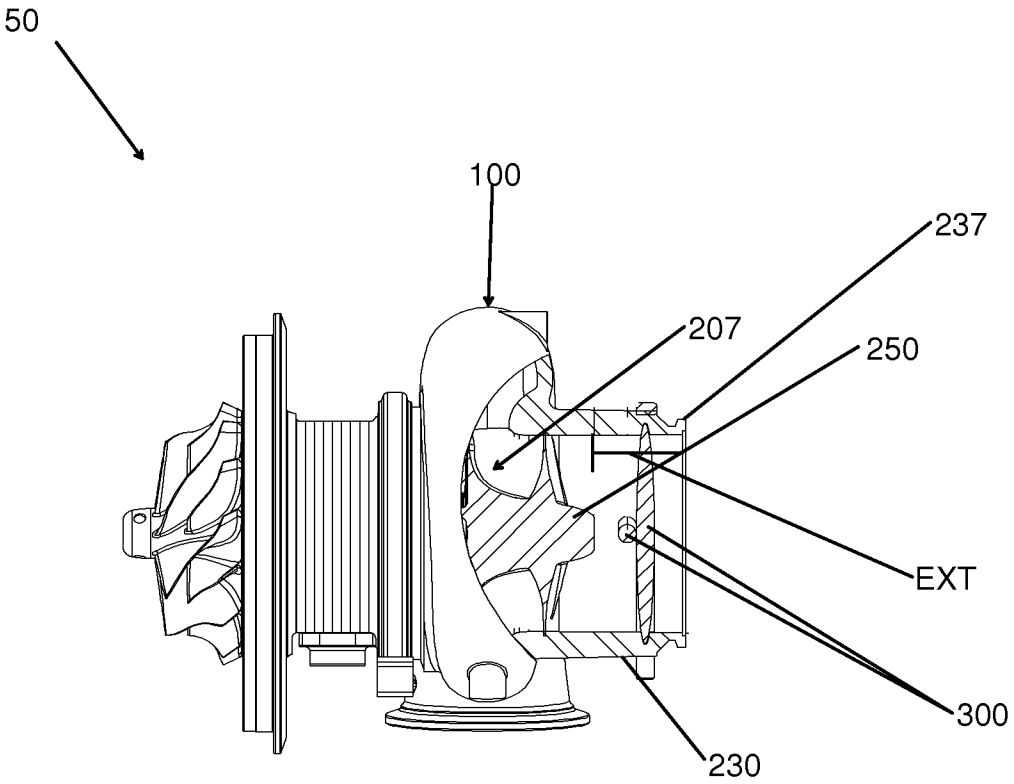
FIG. 2*b* shows a side view of the turbocharger in FIG. 1 with a partial sectional view of the turbine assembly.

As discussed above, the turbine housing 200 includes an outlet portion 230, which is a hollow cylindrical extension from the central portion 220. FIG. 2*b* shows a side view of the turbocharger of FIG. 1 with a partial section view of the turbine 100. As shown in FIG. 2*b*, the outlet portion 230 effectively extends the exit opening of the turbine housing 200 from approximately the position of the turbine wheel 250 to the outlet 237 (shown as length EXT). The outlet portion 230 can be configured to support various types of containment assemblies 300, such as those described below. For example, the outlet portion 230 may include various apertures to receive bolts or other devices. The outlet portion 230 may have various dimensions and thicknesses depending upon the application.

Figure 3:
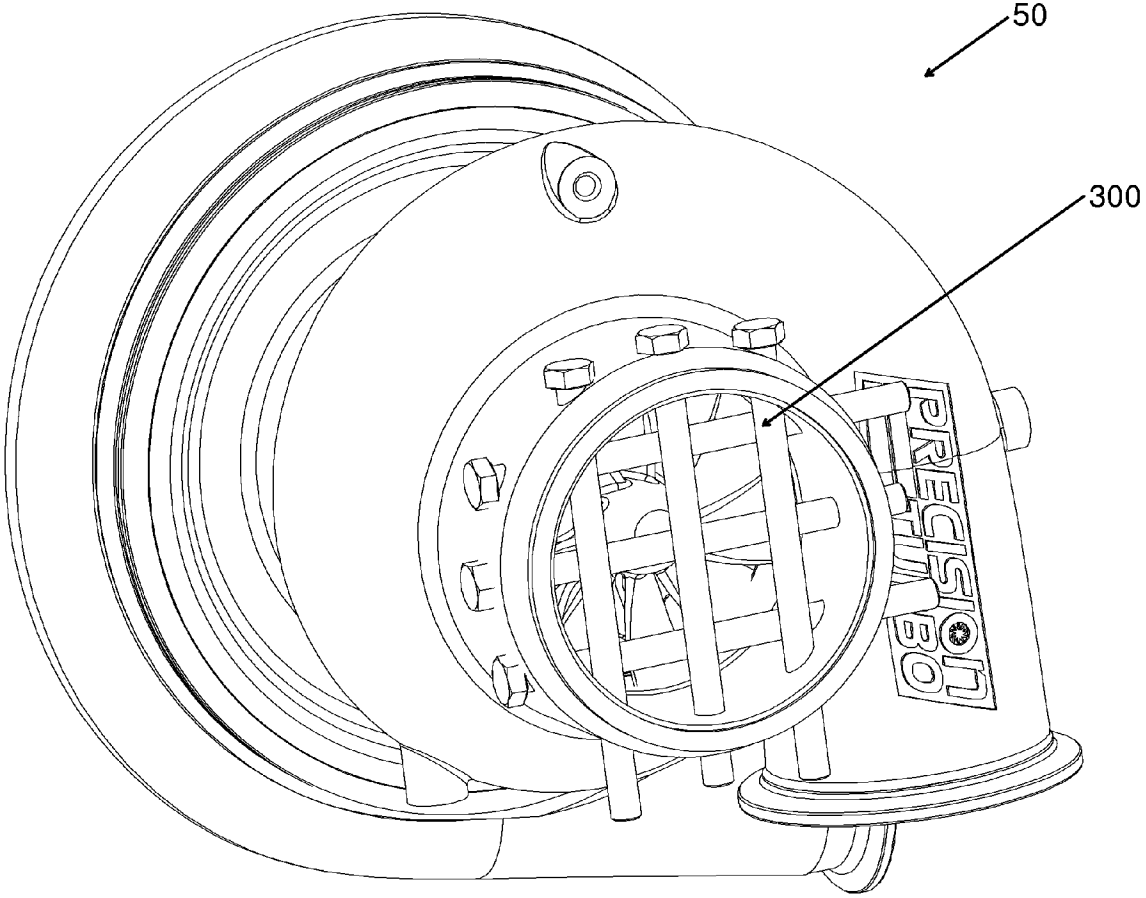
FIG. 3 shows a perspective view of an exemplary turbocharger having a six-bolt containment assembly according to the present disclosure.
Figure 4:
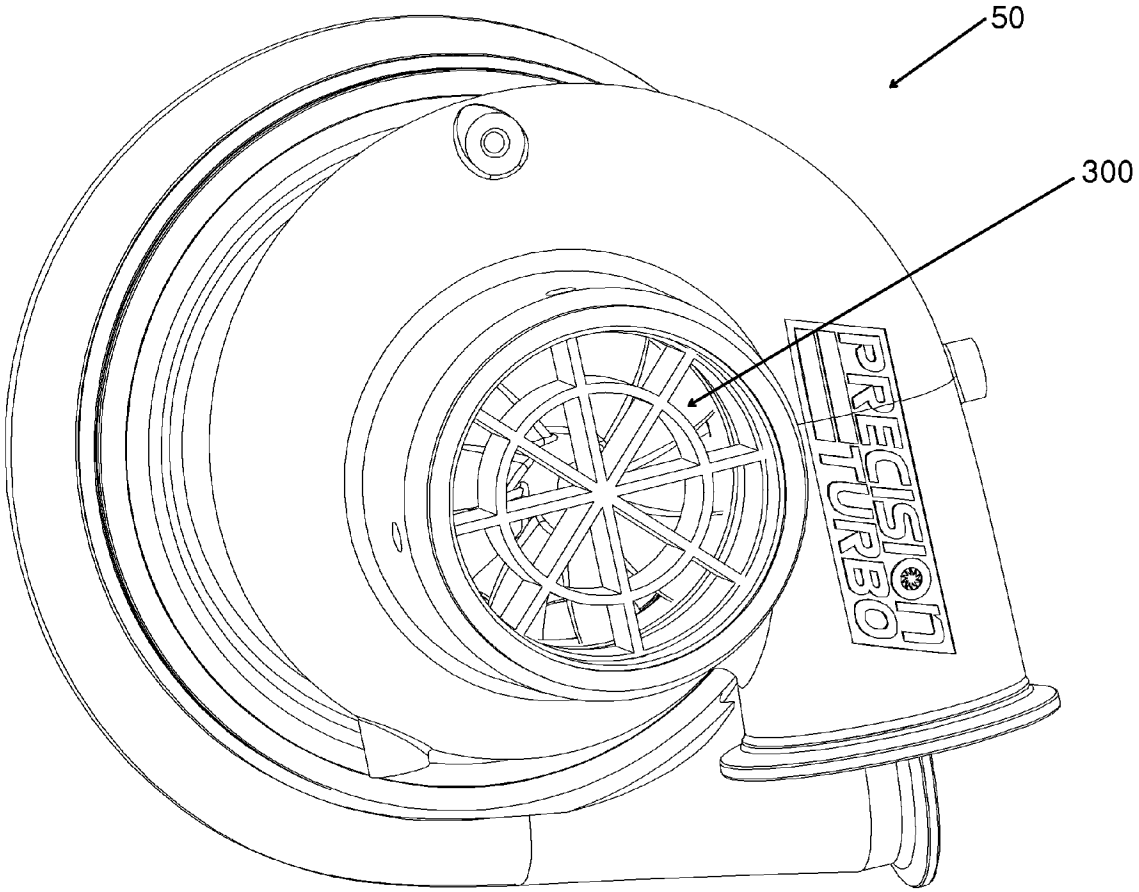
FIG. 4 shows a perspective view of an exemplary turbocharger having a radial mesh containment assembly according to the present disclosure.
Figure 5:
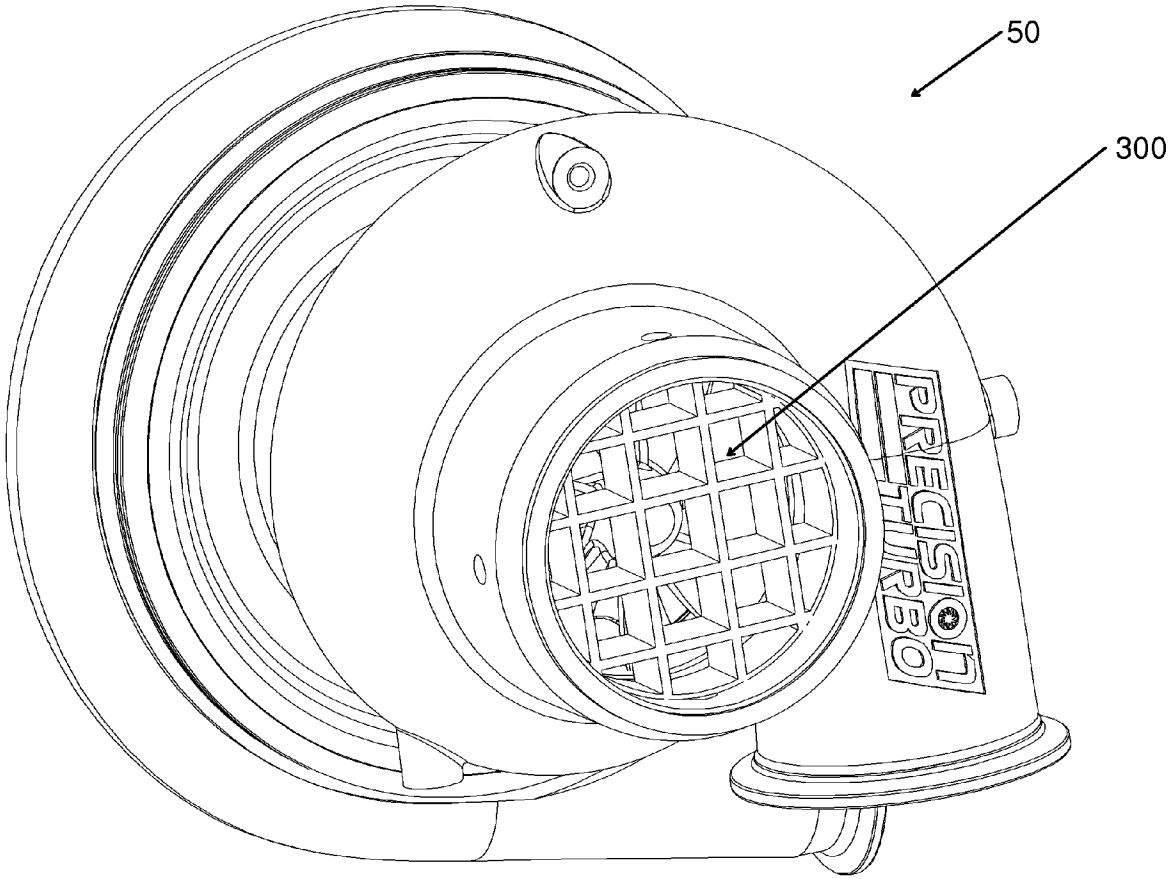
FIG. 5 shows a perspective view of an exemplary turbocharger having a perpendicular mesh containment assembly according to the present disclosure.

As shown in FIGS. 2*a* and 2*b*, the containment assembly 300 is shown as two bolts that are secured to the outlet portion 230 and extend through, and thereby obstruct, the hollow passageway of the outlet portion 230 in a substantially perpendicular configuration. In FIG. 2*a*, the containment assembly 300 is shown located midway between the outlet opening 233 and the outlet 237 of the outlet portion 230. It should be noted that the containment assembly 300 may be positioned anywhere within the outlet portion 230. For example, the containment assembly 300 may be positioned adjacent to the outlet 237 or adjacent to the outlet opening 233. Also, it should be noted that the containment assembly 300 may be two bolts in a different configuration (e.g., parallel to one another) or just one bolt or three or more bolts in various configurations. For example, FIG. 3 shows a turbocharger 50 with a containment assembly 300 having six bolts with three parallel in one direction and three parallel in a direction perpendicular to the other three bolts. As shown in FIGS. 2*a* and 2*b*, the bolts may be staggered along the outlet portion 230. Of course, the bolts may not be staggered but form an X-shape as a single part or may pass through one another. The bolts of the containment assembly 300 may be various sizes and shapes. For example, the bolts may each have a diameter of about 0.953 centimeters (0.375 inches). Also, the containment assembly 300 may be one or more plates, a mesh, or various other devices that partially obstruct the hollow passageway of the outlet portion 230 but allow exhaust gases to pass. For example, FIGS. 4 and 5 show turbochargers 50 having containment assemblies 300 with different mesh patterns.

It shall be understood that smaller and smaller fragments of the turbine wheel 250 can be blocked or slowed by increasing the cross-section of the containment assembly 300. Therefore, the containment assembly 300 can be manipulated based upon the desired application to have a greater cross-sectional area to block or slow smaller fragments or a smaller cross-sectional area to block or slow larger fragments. One of ordinary skill in the art would appreciate that the greater the interruption of the exhaust gas flow by the containment assembly 300, the greater the adverse affect on the overall performance of the turbocharger. Therefore, the containment assembly 300 is typically arranged and/or configured to minimize flow restrictions through the outlet portion 230. By minimizing flow restrictions through the outlet portion 230, the containment assembly 300 is able to provide protection from a burst failure of the turbine wheel 250 without substantially affecting the performance of the turbocharger 50.

While the containment assembly 300 and turbine housing 200 may be a single part (discussed below), it should be noted that the containment assembly 300 may be separate and distinct from the turbine housing 200. In some cases, it may be advantageous for the containment assembly 300 to be removable from the turbine housing 200. For example, the containment assembly 300 will experience significant wear from normal operation of the turbocharger 50. Therefore, the ability to replace or repair just the containment assembly 300, without having to replace the turbine housing 200, would be cost effective. It may also be helpful to have a removable containment assembly 300 to repair or replace the turbine wheel 250.

The turbine housing 200 may be formed as separate, distinct parts or created as a single part. For example, the inlet portion 210, the central portion 220, and the outlet portion 230 may be separate parts that are connected together (e.g., welding, fastening, and the like) to form the turbine housing 200. In another example, the turbine housing 200 may be formed as a single part by using a mold process or other process. Furthermore, while typically the containment assembly 300 and turbine housing 200 may be separate, distinct parts, it should be noted that the containment assembly 300 may also be integrated with the turbine housing 200 such that the housing 200 and containment assembly 300 are created as a single part.

The turbine housing 200 may be formed of various materials, such as, for example, metals, composites, and the like. It should be noted that the inlet portion 210, central portion 220, and outlet portion 230 may each be formed of different materials. In any case, the central portion 220 and outlet portion 230 are configured to contain fragments of the turbine wheel 250 upon the occurrence of a burst failure. For example, the central portion 220 and outlet portion 230 may have a particular thickness and be formed of a material that can withstand a turbine wheel 250 projectile at a particular speed. The containment assembly may also be formed of various materials, such as, for example, high temperature resistant and high ductility materials. For example, the containment assembly may be formed of Inconel®, Incaloy®, or other high nickel, high temperature super alloys.

While this disclosure has been described as having various embodiments, these embodiments according to the present disclosure can be further modified within the scope and spirit of this disclosure. This application is therefore intended to cover any variations, uses, or adaptations of the disclosure using its general principles. A practitioner may determine in a particular implementation that a plurality of components of the disclosed assembly may be combined in various ways, or that different components or different variations of the components may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

What is claimed is:

1. A turbine assembly for a turbocharger comprising a turbine wheel, the turbine assembly comprising:

a turbine housing for a turbocharger comprising an inlet portion, a central portion, and a hollow cylindrical portion defining a hollow passageway and an outlet, the hollow passageway including an outlet portion configured to extend from an outer axial end of the turbine wheel to the outlet, where the inlet portion, central portion, and hollow cylindrical portion are in fluid connection allowing a fluid to enter and pass through the inlet portion to the central portion, pass through the central portion to the hollow passageway, and pass through the hollow passageway to exit the turbine housing through the outlet; and a containment assembly disposed in and secured only to the outlet portion of the hollow passageway of the hollow cylindrical portion and having one or more obstructing members configured to be axially spaced from the turbine wheel in the outlet portion of the hollow passageway and extending through the hollow passageway to obstruct the movement of portions of the turbine wheel through the hollow passageway, wherein the containment assembly comprises a mesh.

2. A turbocharger comprising:

a turbine wheel having an outer axial end;

a turbine housing for a turbocharger comprising an inlet portion, a central portion, and a hollow cylindrical portion that defines a hollow passageway and an outlet, the hollow passageway including an outlet portion extending from the outer axial end of the turbine wheel to the outlet, where the turbine wheel is disposed within the central portion adjacent to the hollow cylindrical portion and where the inlet portion, central portion, and hollow cylindrical portion are in fluid connection allowing a fluid to enter and pass through the inlet portion to the central portion, pass through the central portion to the hollow passageway, and pass through the hollow passageway to exit the turbine housing through the outlet; and a containment assembly disposed in and secured only to the outlet portion of the hollow passageway of the hollow cylindrical portion and having one or more obstructing members axially spaced from the turbine wheel in the outlet portion of the hollow passageway and extending through the hollow passageway, the containment assembly configured to obstruct the movement of portions of the turbine wheel through the hollow passageway, wherein the containment assembly comprises a mesh.

3. A turbine assembly for a turbocharger comprising:

a turbine wheel;

a turbine housing for a turbocharger comprising:

a hollow central portion having a central opening and the turbine wheel disposed within the turbine housing adjacent to the central opening;

a hollow cylindrical inlet portion having a first inlet end and a second inlet end, where the first inlet end defines an inlet opening and the second inlet end is connected to the central portion; and a hollow cylindrical outlet portion having a first outlet end and a second outlet end defining an outlet portion therebetween, where the first outlet end is connected to the hollow central portion about the central opening and the second outlet end defines an outlet opening;

wherein the hollow cylindrical inlet portion, hollow central portion, and hollow cylindrical outlet portion are fluidly connected such that a fluid can enter the first inlet end, pass through the hollow cylindrical inlet portion to the second inlet end, enter and pass through the hollow central portion, and exit through the outlet; and a containment assembly disposed in and secured only to the outlet portion of the hollow cylindrical outlet portion and having one or more obstructing members axially spaced from the turbine wheel in the outlet portion of the hollow cylindrical outlet portion and extending through the hollow cylindrical outlet portion, the containment assembly configured to obstruct the movement of portions of the turbine wheel through the hollow cylindrical outlet portion, wherein the containment assembly comprises at least two bolts parallel to one another, each of the at least two bolts extending through the outlet portion of the hollow cylindrical outlet portion.

4. A turbine assembly for a turbocharger comprising a turbine wheel and a turbine shaft disposed along a rotational axis of the turbine wheel, the turbine assembly comprising:

a turbine housing for a turbocharger comprising an inlet portion, a central portion, and a hollow cylindrical portion defining a hollow passageway and an outlet, the hollow passageway including an outlet portion configured to extend from an outer axial end of the turbine wheel to the outlet, where the inlet portion, central portion, and hollow cylindrical portion are in fluid connection allowing a fluid to enter and pass through the inlet portion to the central portion, pass through the central portion to the hollow passageway, and pass through the hollow passageway to exit the turbine housing through the outlet; and a containment assembly disposed in and secured to the outlet portion of the hollow passageway of the hollow cylindrical portion and having one or more obstructing members configured to be axially spaced from the turbine wheel and the turbine shaft in the outlet portion of the hollow passageway and extending through the hollow passageway to obstruct the movement of portions of the turbine wheel through the hollow passageway, wherein the containment assembly comprises a mesh.

5. The turbine assembly of claim 4, A turbine assembly for a turbocharger comprising a turbine wheel and a turbine shaft disposed along a rotational axis of the turbine wheel, the turbine assembly comprising:

a turbine housing for a turbocharger comprising an inlet portion, a central portion, and a hollow cylindrical portion defining a hollow passageway and an outlet, the hollow passageway including an outlet portion configured to extend from an outer axial end of the turbine wheel to the outlet, where the inlet portion, central portion, and hollow cylindrical portion are in fluid connection allowing a fluid to enter and pass through the inlet portion to the central portion, pass through the central portion to the hollow passageway, and pass through the hollow passageway to exit the turbine housing through the outlet; and a containment assembly disposed in and secured to the outlet portion of the hollow passageway of the hollow cylindrical portion and having one or more obstructing members configured to be axially spaced from the turbine wheel and the turbine shaft in the outlet portion of the hollow passageway and extending through the hollow passageway to obstruct the movement of portions of the turbine wheel through the hollow passageway, wherein the containment assembly comprises at least two bolts parallel to one another, each of the at least two bolts extending through the outlet portion of the hollow passageway.

6. A turbocharger comprising:

a turbine wheel having an outer axial end;

a turbine shaft disposed at a rotational axis of the turbine wheel;

a turbine housing for a turbocharger comprising an inlet portion, a central portion, and a hollow cylindrical portion that defines a hollow passageway and an outlet, the hollow passageway including an outlet portion extending from the outer axial end of the turbine wheel to the outlet, where the turbine wheel is disposed within the central portion adjacent to the hollow cylindrical portion and where the inlet portion, central portion, and hollow cylindrical portion are in fluid connection allowing a fluid to enter and pass through the inlet portion to the central portion, pass through the central portion to the hollow passageway, and pass through the hollow passageway to exit the turbine housing through the outlet; and a containment assembly disposed in and secured to the outlet portion of the hollow passageway of the hollow cylindrical portion and having one or more obstructing members axially spaced from the turbine wheel and the turbine shaft in the outlet portion of the hollow passageway and extending through the hollow passageway, the containment assembly configured to obstruct the movement of portions of the turbine wheel through the hollow passageway, wherein the containment assembly comprises at least two bolts parallel to one another, each of the at least two bolts extending through the outlet portion of the hollow passageway.

7. The turbocharger of claim 6, A turbocharger comprising:

a turbine wheel having an outer axial end;

a turbine shaft disposed at a rotational axis of the turbine wheel;

a turbine housing for a turbocharger comprising an inlet portion, a central portion, and a hollow cylindrical portion that defines a hollow passageway and an outlet, the hollow passageway including an outlet portion extending from the outer axial end of the turbine wheel to the outlet, where the turbine wheel is disposed within the central portion adjacent to the hollow cylindrical portion and where the inlet portion, central portion, and hollow cylindrical portion are in fluid connection allowing a fluid to enter and pass through the inlet portion to the central portion, pass through the central portion to the hollow passageway, and pass through the hollow passageway to exit the turbine housing through the outlet; and a containment assembly disposed in and secured to the outlet portion of the hollow passageway of the hollow cylindrical portion and having one or more obstructing members axially spaced from the turbine wheel and the turbine shaft in the outlet portion of the hollow passageway and extending through the hollow passageway, the containment assembly configured to obstruct the movement of portions of the turbine wheel through the hollow passageway, wherein the containment assembly comprises a mesh.

8. A turbine assembly for a turbocharger comprising:

a turbine wheel;

a turbine shaft disposed at a rotational axis of the turbine wheel;

a turbine housing for a turbocharger comprising:

a hollow central portion having a central opening and the turbine wheel disposed within the turbine housing adjacent to the central opening;

a hollow cylindrical inlet portion having a first inlet end and a second inlet end, where the first inlet end defines an inlet opening and the second inlet end is connected to the central portion; and a hollow cylindrical outlet portion having a first outlet end and a second outlet end defining an outlet portion therebetween, where the first outlet end is connected to the hollow central portion about the central opening and the second outlet end defines an outlet opening;

wherein the hollow cylindrical inlet portion, hollow central portion, and hollow cylindrical outlet portion are fluidly connected such that a fluid can enter the first inlet end, pass through the hollow cylindrical inlet portion to the second inlet end, enter and pass through the hollow central portion, and exit through the outlet; and a containment assembly disposed in and secured to the outlet portion of the hollow cylindrical outlet portion and having one or more obstructing members axially spaced from the turbine wheel and the turbine shaft in the outlet portion of the hollow cylindrical outlet portion and extending through the hollow cylindrical outlet portion, the containment assembly configured to obstruct the movement of portions of the turbine wheel through the hollow cylindrical outlet portion, wherein the containment assembly comprises at least two bolts parallel to one another, each of the at least two bolts extending through the outlet portion of the hollow cylindrical outlet portion.

9. A turbine assembly for a turbocharger comprising a turbine wheel, the turbine assembly comprising:

a turbine housing for a turbocharger comprising an inlet portion, a central portion, and a hollow cylindrical portion defining a hollow passageway and an outlet, the hollow passageway including an outlet portion configured to extend from an outer axial end of the turbine wheel to the outlet, where the inlet portion, central portion, and hollow cylindrical portion are in fluid connection allowing a fluid to enter and pass through the inlet portion to the central portion, pass through the central portion to the hollow passageway, and pass through the hollow passageway to exit the turbine housing through the outlet; and a containment assembly disposed in and secured only to the outlet portion of the hollow passageway of the hollow cylindrical portion and having one or more obstructing members configured to be axially spaced from the turbine wheel in the outlet portion of the hollow passageway and extending through the hollow passageway to obstruct the movement of portions of the turbine wheel through the hollow passageway, wherein the containment assembly comprises at least two bolts parallel to one another, each of the at least two bolts extending through the outlet portion of the hollow passageway.

10. A turbocharger comprising:

a turbine wheel having an outer axial end;

a turbine housing for a turbocharger comprising an inlet portion, a central portion, and a hollow cylindrical portion that defines a hollow passageway and an outlet, the hollow passageway including an outlet portion extending from the outer axial end of the turbine wheel to the outlet, where the turbine wheel is disposed within the central portion adjacent to the hollow cylindrical portion and where the inlet portion, central portion, and hollow cylindrical portion are in fluid connection allowing a fluid to enter and pass through the inlet portion to the central portion, pass through the central portion to the hollow passageway, and pass through the hollow passageway to exit the turbine housing through the outlet; and a containment assembly disposed in and secured only to the outlet portion of the hollow passageway of the hollow cylindrical portion and having one or more obstructing members axially spaced from the turbine wheel in the outlet portion of the hollow passageway and extending through the hollow passageway, the containment assembly configured to obstruct the movement of portions of the turbine wheel through the hollow passageway, wherein the containment assembly comprises at least two bolts parallel to one another, each of the at least two bolts extending through the outlet portion of the hollow passageway.

* * * * *